US010357801B2

(12) United States Patent
Tse et al.

(10) Patent No.: US 10,357,801 B2
(45) Date of Patent: Jul. 23, 2019

(54) SYSTEM AND A METHOD OF MANUFACTURING A RELEASE SHEET FOR USE IN REPLICATIVE EMBOSSING

(71) Applicant: Vantage Technology Limited, Tai Po (HK)

(72) Inventors: Chui Wan Tse, Tai Po (HK); Chi Hang Cheung, Tai Po (HK)

(73) Assignee: VANTAGE TECHNOLOGY LIMITED, New Territories (HK)

( * ) Notice: Subject to any disclaimer, the term of this patent is extended or adjusted under 35 U.S.C. 154(b) by 141 days.

(21) Appl. No.: 15/287,044

(22) Filed: Oct. 6, 2016

(65) Prior Publication Data

US 2017/0100745 A1 Apr. 13, 2017

(30) Foreign Application Priority Data

Oct. 7, 2015 (HK) ..... 15109787.1
Aug. 30, 2016 (CN) ..... 2016 1 0766820

(51) Int. Cl.

*B05D 1/40* (2006.01)
*B05D 1/26* (2006.01)
*B05D 3/06* (2006.01)

(52) U.S. Cl.

CPC ..... *B05D 1/40* (2013.01); *B05D 1/26* (2013.01); *B05D 3/068* (2013.01); *B05D 2252/02* (2013.01)

(58) Field of Classification Search

CPC ..... B05D 1/40
USPC ..... 216/83
See application file for complete search history.

(56) References Cited

U.S. PATENT DOCUMENTS

2004/0062913 A1* 4/2004 Suto ..... B32B 27/12 428/141

* cited by examiner

*Primary Examiner* — Roberts P Culbert
(74) *Attorney, Agent, or Firm* — Renner Kenner Greive Bobak Taylor & Weber

(57) ABSTRACT

A method of manufacturing a release sheet for use in replicative embossing includes manipulating a surface morphology of a replicative surface having a predefined embossing pattern; and depositing and embossing a coating material on a substrate of the release sheet with the replicative surface, wherein both the predefined embossing pattern and the surface morphology of the replicative surface is transferred to the coating material of the release sheet.

18 Claims, 13 Drawing Sheets

(200)

(500)

SYSTEM AND A METHOD OF MANUFACTURING A RELEASE SHEET FOR USE IN REPLICATIVE EMBOSSING

TECHNICAL FIELD

The present invention relates to a system and method of manufacturing a release sheet for use in replicative embossing, and particularly, although not exclusively, to a method of modifying a gloss level of a release sheet.

BACKGROUND

Replicative embossing is a technique used for producing multiple products with repeat patterns. For example, predefined patterns on a replicative surface may be transferred to a surface or one or more layers of a final product, and the replicative surface may be repeatedly used to produce another piece of the same product or it may be used for transferring the same pattern to other pieces of different product.

The technique of replicative embossing may also be employed in roll-to-roll printing/coating systems. In these systems, the replicative surface may be the surface of an embossing roller, the replicative surface may then continuously and repeatedly roll and contact with the embossed layer or surface.

In some applications, a release liner or a release sheet can be used as a carrier to produce synthetic leather which is widely used in daily products. For example, sport shoes, handbag or furniture. Release liner can be cured by different kinds of technologies, including thermal curing or radiation curing.

SUMMARY OF THE INVENTION

In accordance with a first aspect of the present invention, there is provided a method of manufacturing a release sheet for use in replicative embossing, comprising the steps of:

manipulating a surface morphology of a replicative surface having a predefined embossing pattern;

depositing and embossing a coating material on a substrate of the release sheet with the replicative surface; and wherein both the predefined embossing pattern and the surface morphology of the replicative surface is transferred to the coating material of the release sheet.

In an embodiment of the first aspect, the manipulated surface morphology is developed across the entire replicative surface and the predefined embossing pattern.

In an embodiment of the first aspect, the step of manipulating the surface morphology of the replicative surface includes modifying a gloss level of the replicative surface.

In an embodiment of the first aspect, the step of manipulating the surface morphology of the replicative surface comprises the step of etching the replicative surface with a chemical etchant.

In an embodiment of the first aspect, the chemical etchant includes at least one of ferric chloride, ferric nitrate, nitric acid and hydrochloric acid.

In an embodiment of the first aspect, the concentration of etchant solution is in a range of 0%-50% by mass.

In an embodiment of the first aspect, the step of etching the replicative surface with the chemical etchant comprises the steps of:

pouring the chemical etchant on the replicative surface for a predetermined etching period;

brushing the replicative surface when the chemical etchant is poured on the replicative surface; and when upon the predetermined etching period is lapsed, stop pouring the chemical etchant on the replicative surface and pouring a predetermined amount of water on the replicative surface, wherein the predetermined amount of water is arranged to quench a chemical reaction of the chemical etchant poured on the replicative surface.

In an embodiment of the first aspect, further comprising the step of washing the replicative surface with water before the step of etching the replicative surface with a chemical etchant.

In an embodiment of the first aspect, the step of manipulating the surface morphology of the replicative surface further comprises the step of mechanically polishing the replicative surface.

In an embodiment of the first aspect, the replicative surface is made of a metallic material.

In an embodiment of the first aspect, the metallic material consists of nickel, copper, brass, aluminum, a nickel-based alloy and/or an iron based alloy.

In an embodiment of the first aspect, the step of depositing and embossing the coating material on a substrate of the release sheet with the replicative surface includes the steps of:

applying the coating material to the replicative surface; and transferring the coating material to the substrate by pressing the substrate against the replicative surface.

In an embodiment of the first aspect, the coating material is irradiation curable.

In an embodiment of the first aspect, further comprising the step of curing the coating material deposited on the substrate.

In an embodiment of the first aspect, wherein the coating material is cured with electron beam energy.

In an embodiment of the first aspect, further comprising the step of separating the cured coating material and the substrate from the replicative surface.

In an embodiment of the first aspect, the coating material consists of acrylate.

In an embodiment of the first aspect, the substrate includes paper.

In accordance with a second aspect of the present invention, there is provided a method of manufacturing synthetic leather, comprising the steps of depositing a skin layer coating to a release sheet manufactured by the method in accordance with the first aspect.

In an embodiment of the second aspect, further comprising the steps of:

drying the skin layer coating by evaporating solvent in the skin layer coating;

depositing an adhesive layer to the skin layer coating;

attaching a fabric substrate to the adhesive layer; and detaching the skin layer coating and the fabric substrate from the release sheet.

In an embodiment of the second aspect, further comprising the step of heating the skin layer coating, the adhesive layer and the fabric substrate for binding the skin layer coating to the fabric substrate.

In an embodiment of the second aspect, the skin layer coating consists of polyurethane and/or polyvinyl chloride.

In accordance with a third aspect of the present invention, there is provided a release sheet for use in replicative embossing comprising a substrate and a coating material on the substrate, wherein a surface of the coating material is defined with a composite surface texture including an embossing pattern and a surface morphology, and the composite surface texture is transferred from a replicative surface manipulated by a method in accordance with the first aspect.

In accordance with a fourth aspect of the present invention, there is provided an embossing roller for use in manufacturing a release sheet for replicative embossing, comprising a replicative surface having a composite surface texture thereon, wherein the composite surface includes a predefined embossing pattern and a surface morphology, and wherein the surface morphology is manipulated according to a method in accordance with the first aspect.

In accordance with a fifth aspect of the present invention, there is provided a system of manufacturing a release sheet for use in a manufacturing of synthetic leather, comprising:

at least one substrate holder arranged to hold and manipulate a substrate of the release sheet;

a coating stage for applying an irradiation curable acrylate coating material to a replicative surface of an embossing roller, wherein the irradiation curable acrylate coating material is arranged to be transferred to the substrate by pressing the substrate against the replicative surface of the embossing roller; and an electron beam source for curing the irradiation curable acrylate coating material by irradiating an electron beam to the irradiation curable acrylate coating material through the substrate to transform the irradiation curable acrylate coating material to a cured acrylate coating on the substrate;

wherein the replicative surface is made of a metal and includes a predefined embossing pattern, and a gloss of the replicative surface on the embossing roller is arranged to be modified by an embossing roller etching stage comprising:

a chemical etching stage for etching the replicative surface with a chemical etchant including ferric chloride solution for a predetermined etching period, wherein the concentration of ferric chloride solution is in a range of 0%-50% by mass; and a cleaning stage for cleaning the replicative surface before the replicative surface is etched, and for quenching a chemical reaction of the chemical etchant on the replicative surface when upon the predetermined etching period is lapsed;

wherein the predefined embossing pattern and the gloss of the replicative surface are combined to define a composite surface texture on the replicative surface, and the composite surface texture is arranged to be transferred to the irradiation curable acrylate coating material on the substrate; and wherein the cured acrylate coating is arranged to adhere to the substrate and is further arranged to be separated from the embossing roller meanwhile the substrate is detached from the embossing roller.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Without wishing to be bound by theory, the inventors have, through their own research, trials and experiments, devised that apart from providing a desired surface effect for the synthetic leather, the liner also providing a stable gloss effect for the synthetic leather. In order to tune the gloss of the synthetic leather, the synthetic leather formulation may have to be changed, but the consistency of the gloss is difficult to be controlled.

It is found by the inventors that by tuning the gloss of release paper, the gloss of polyurethane (PU) or polyvinyl chloride (PVC) can be replicated in a high consistency.

Figure 1:
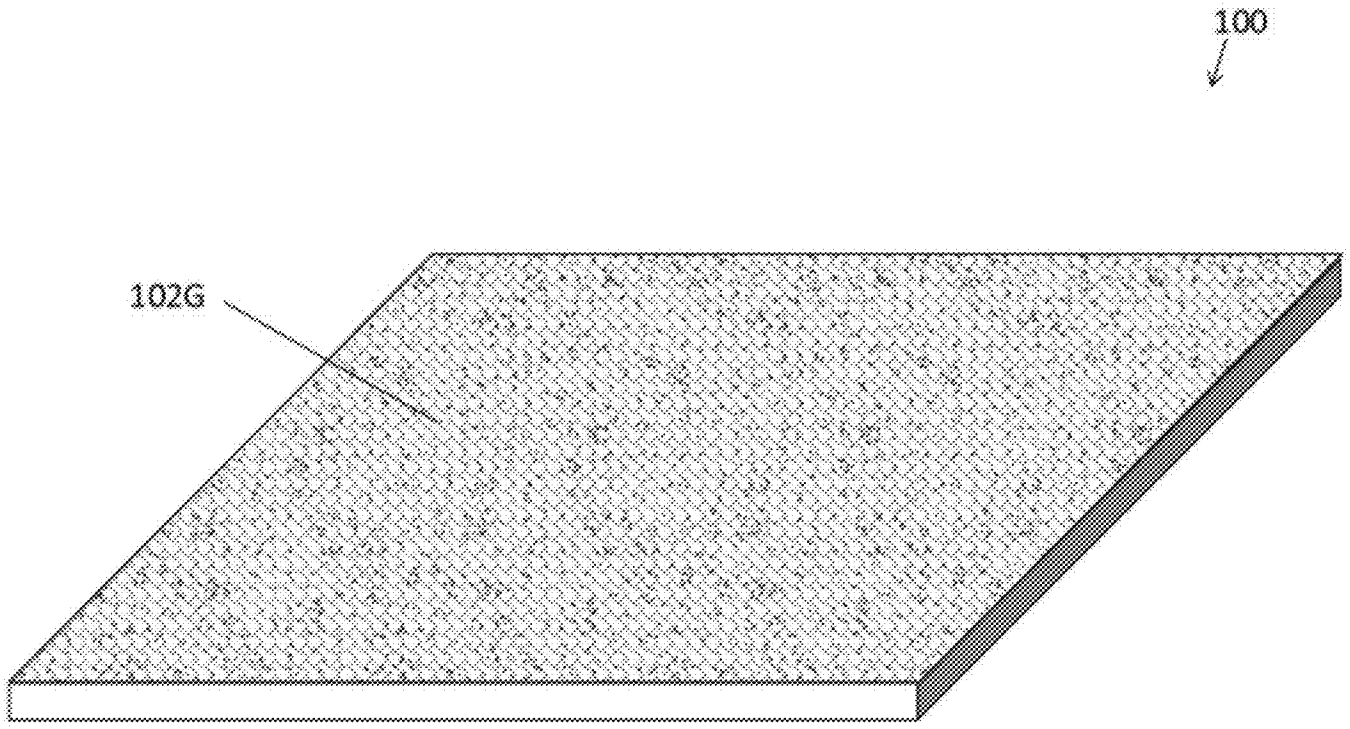
FIG. 1 is an illustration of a replicative surface having a predefined embossing pattern with a modified surface morphology in accordance with an embodiment of the present invention.
Figure 2:
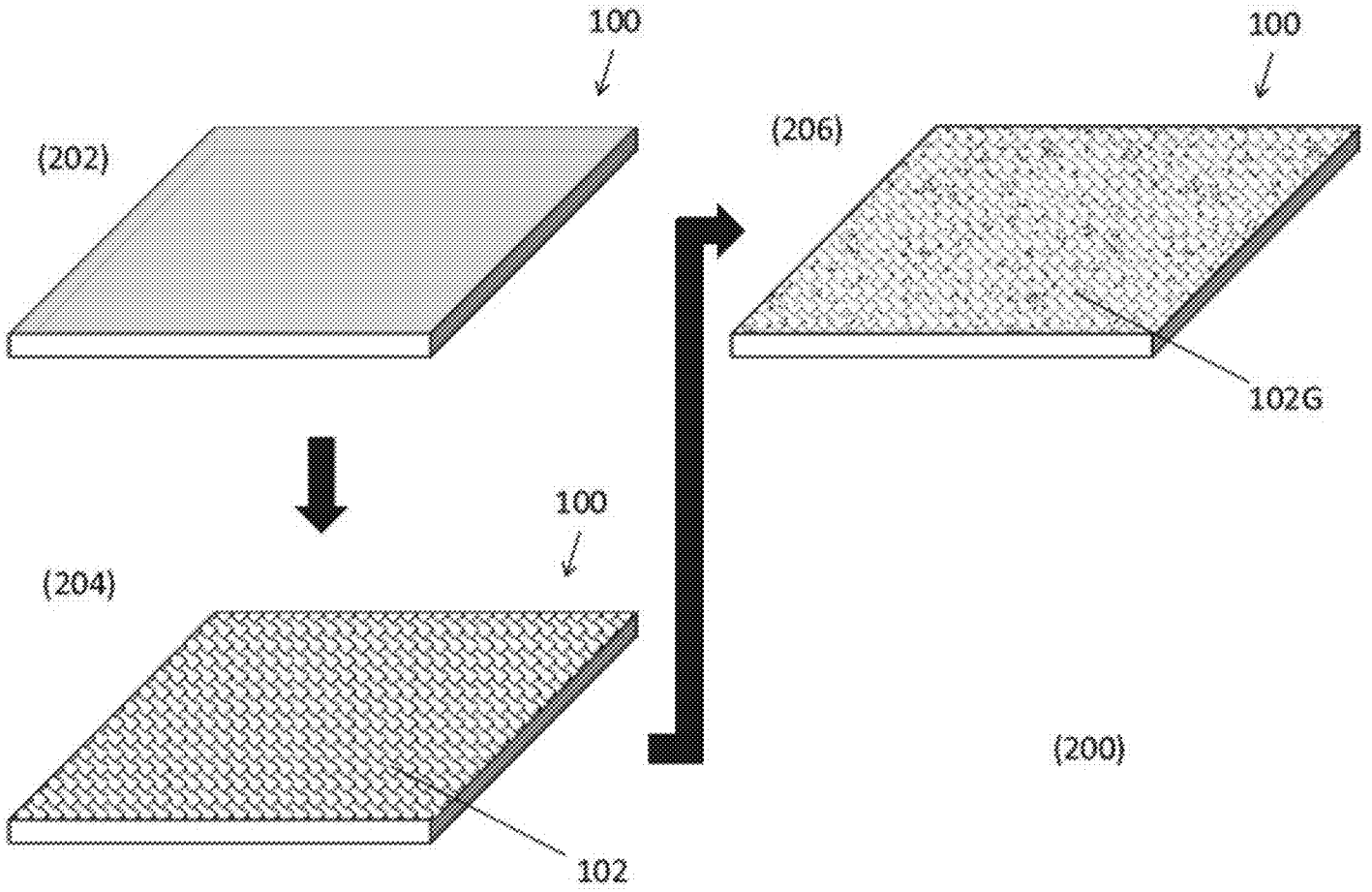
FIG. 2 is an illustration of a process of manipulating a surface morphology of a replicative surface of FIG. 1 having a predefined embossing pattern.

With reference to FIGS. 1 to 2, there is provided an embodiment of a method of manufacturing a release sheet for use in replicative embossing, comprising the steps of: manipulating a surface morphology of a replicative surface 100 having a predefined embossing pattern 102 so as to define a composite surface texture 102G combining the predefined embossing pattern 102 and the manipulated surface morphology on the replicative surface 100; and depositing and embossing a coating material on a substrate of the release sheet with the replicative surface 100; wherein composite surface texture 102G of the replicative surface 100 is transferred to the coating material of the release sheet.

In this embodiment, a release sheet such as a release paper or a release liner may be produced by using the replicative surface 100. The release sheet may comprise a substrate such as a paper substrate, a polymer substrate or any flexible substrate. A layer of polymer such as polyacrylates or other oligomer is formed on the substrate. Such layer of polymer maybe used as a release coating in a manufacturing process. For an application such as using the release sheet for the manufacturing of synthetic leather, the polymer layer comprises predefined embossing patterns in which the patterns are transferred to the surface of the synthetic leather during the manufacturing process.

Release coating may provide an easy release, temperature resistance and good abrasive properties and may act as a carrier to produce synthetic leather having a layer of polyurethane (PU), polyvinyl chloride (PVC) and semi-PU (which may consist of PU and PVC layer) etc. In order to provide a surface effect (such as a predefined embossing pattern) on the paper, an embossing roller may be used in producing the release paper, The fabrication of release liner may employ an electron beam radiation technology. By using such technology, the continuity of the release layer is maintained. The synthetic leather produced may provide a 100% replicative surface (including the predefined embossing pattern and the modified surface morphology on the replicative surface) transferred from the embossing roller and the alteration of the desired surface is minimized.

Electron beam (e-beam) curing operates with incoming high speed electrons knocking off other electrons in the polymer mixture. The high energy of the electron beams can penetrate into the composite and result in a uniform cure to the materials. Radiation curing permits the use of solvent-free adhesive compositions. The major effects in the coating arise from the dissociation of primary valence bonds into radicals. The dissociations of C—C and C—H bonds lead to different results, degradation and crosslinking, which may occur simultaneously.

In different example embodiments, the release sheet may comprise an acrylate oligomer, acrylate monomer and/or a silicone releasing agent. During the manufacturing process, the surface effect and a surface morphology (such as a gloss level or a gloss effect) are controlled by the embossing roller. In general, the higher of the gloss of the roller, the higher gloss level of the release liner produced and higher gloss of synthetic leather will be achieved.

The gloss of the replicative surface 100 of an embossing roller may be tuned or manipulated according to embodiments of the present invention. With reference to FIG. 2, the process 200 of producing a release sheet further includes manipulating a surface morphology of a replicative surface 100 having a predefined embossing pattern 102, which includes the modification of a gloss level of the replicative surface 100 to define a composite surface texture 102G.

The process 200 start with step 202, a replicative surface 100 is provided. The replicative surface 100 is preferably a metal surface or a metal roller with a metal surface. In step 204, a predetermined embossing pattern 102 is defined or engraved on the surface of the metal surface 100. Subsequently, in step 206, the metal surface 100 with the predefined embossing pattern 102 is further processed by a chemical etching step so as to modify the surface morphology or the gloss level of the replicative surface 100 so as to define a composite surface texture 102G combining the predefined embossing pattern and the gloss level developed.

In this chemical etching step 204, the replicative surface 100 is processed or etched with a chemical etchant such as ferric chloride, ferric nitrate, nitric acid and/or hydrochloric acid. Ferric chloride is suitable for etching replicative surface 100 made of a metallic material such as nickel. Alternatively, the replicative surface may be made of copper, brass, aluminum, nickel-based alloys and/or iron based alloys such as stainless steel. It will be appreciated by a skilled person that different etchants may be used in etching nickel and/or other metallic/non-metallic surfaces.

Preferably, the etching process 206 comprises a number of steps. The replicative surface 100 is washed with water or any other suitable cleaning agents to prevent any dirt or impurity staying on the replicative surface. Then, the chemical etchant is poured on the replicative surface 100 for a predetermined etching period. During the etching period, the surface morphology of the replicative surface 100 is modified as a result of chemical reaction between the chemical etchant and the material of the replicative surface 100. The replicative surface 100 may be brush during the etching period to ensure that the etchant may contact with the replicative surface 100 thoroughly.

Since the entire replicative surface 100 is exposed or in contact with the chemical etchant, the manipulated surface morphology and hence the composite surface texture 102G is developed across the entire replicative surface 100 and the predefined embossing pattern 102. In an alternative example, etching resist may be applied on a selected area of the replicative surface 100 such that only the exposed area will have the desired composite surface texture developed.

When upon the predetermined etching period is lapsed, the chemical reaction of the chemical etchant is stopped by pouring a predetermined amount of water on the replicative surface 100 after stopping pouring the chemical etchant on the replicative surface 100. Preferably a large (or an excess) amount of water may be used to quench the chemical reaction of the chemical etchant poured on the replicative surface 100. Optionally, mechanical polishing may be performed on the replicative surface 100 before and/or after the etching process to obtain a desired surface texture and/or morphology on the replicative surface 100.

The modification of surface morphology or the gloss level of the replicative surface 100 may be optimized by etching the replicative surface 100 with different types of etchant, concentrations of etchant, etching temperatures and etching periods. In some example embodiments, the concentration of ferric chloride solution is in a range of 0%-50% by mass, and the etching is carried out in room temperature or 40° C. for several minutes such as 10 minutes. Optionally, the etching process may be repeated for multiple times with same or different process parameters to obtain a desired surface morphology or gloss level on the replicative surface 100.

Preferably, the etching solution is freshly prepared prior to etching the replicative surfaces 100.

The method of applying the chemical etchant on the replicative surface 100 should not be limited to pouring of the etchant on the replicative surface 100. For example, chemical etchant may be applied on the replicative surface 100 by other methods or using other apparatus such as spraying the etchant on the replicative surface, immersing the replicative surface into a container of the chemical etchant, or exposing the replicative surface in a reaction chamber filled with the chemical etchant. It is also understood that the chemical etchant is not limited to solution-based chemicals, chemicals in other phases or suitable form may also be used according to the method used for modifying the surface morphology of the replicative surface.

Figure 3:
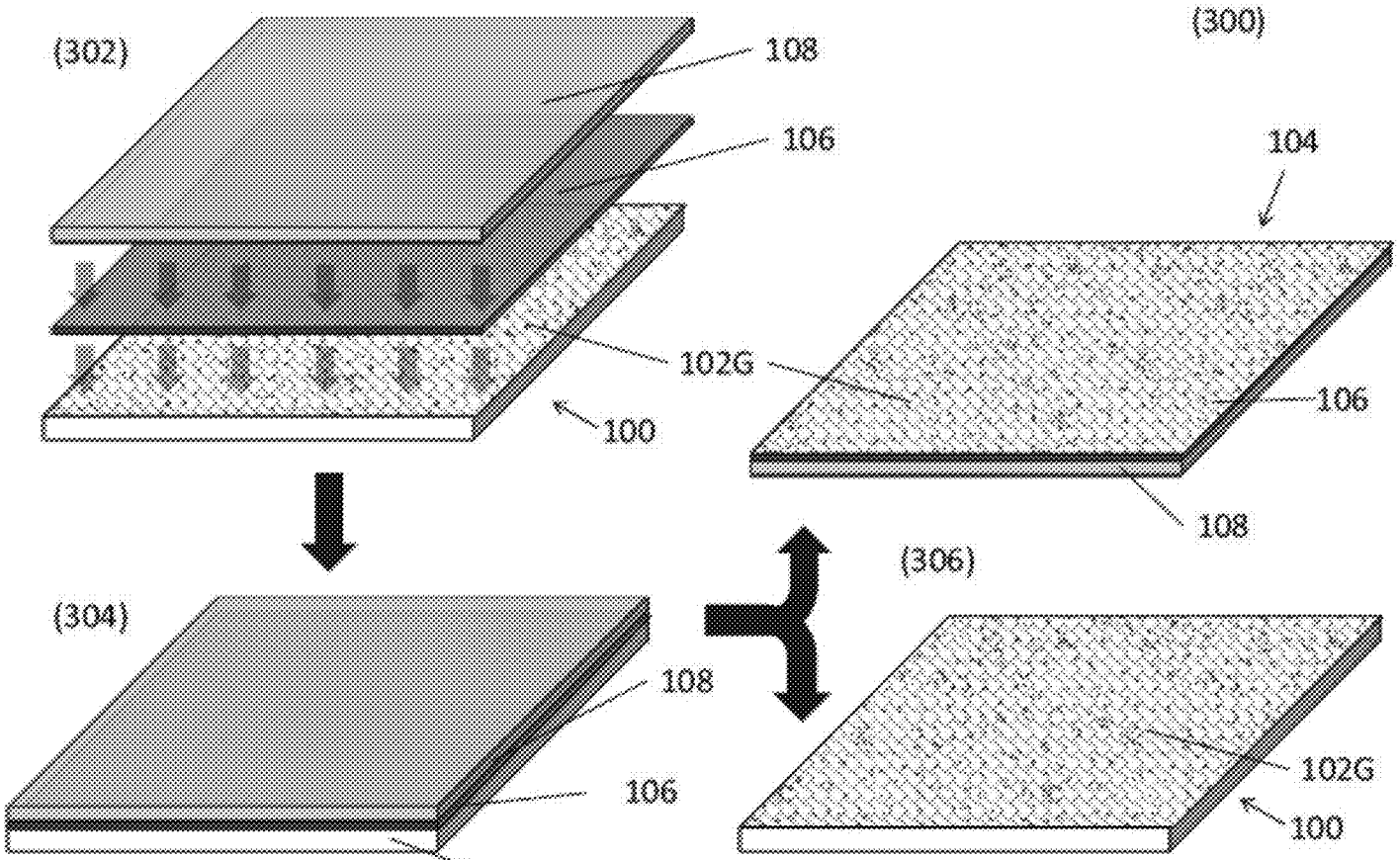
FIG. 3 is an illustration of a process of manufacturing a release sheet using the replicative surface of FIG. 1.

With reference of FIG. 3, the replicative surface 100 having the modified surface morphology or gloss level and the predefined embossing pattern 102 (i.e. the composite surface texture 102G) may be used for the manufacturing of a release sheet 104 such as a release paper. This process 300 may begin with the step 302 of depositing a coating material 106 on a substrate 108 of the release sheet 104, and then in step 304, embossing the coating material 106 deposited so as to transfer the composite surface texture 102G including the predefined embossing pattern 102 and the surface morphology of the replicative surface 100 to the coating material 106 of the release sheet 104.

In steps 302 and 304, based on different coating techniques used, coating material 106 may be applied either on the replicative surface 100 and then placing the substrate 108 on the applied coating material 106, or the coating material 106 may be applied on the substrate 108 and then the replicative surface 100 may be placed on the applied coating material 106. By applying suitable pressure on the replicative surface 100 against the substrate 108, the composite surface texture 102G on the replicative surface 100 is "pressed" against the coating material 106 between the replicative surface 100 and the substrate 108, and hence the composite surface texture 102G having the predefined embossing pattern 102 and the surface morphology is transferred to the coating material 106.

Preferably, the coating material 106 is irradiation curable, and in some examples, the coating material 106 deposited on the substrate 108 may be cured with electron beam curing as discussed earlier in this disclosure. For example, polyacrylates may be applied for radiation-curable coating. Acrylates provide good mechanical and physical properties such as impact strength, adhesion and flexibility.

Polyacrylate resin could be functionalized with different chemical group in order to tune its physical properties. The degree of phase separation between the soft and hard segments will affect the properties of the films, such as hardness, flexibility, chemicals resistance.

Alternatively, various kind of acrylated oligomer may be used in order to meet the specific application requirements. For examples, epoxy acrylate, acrylic acrylates, polyester acrylates, aromatic acrylate and aliphatic acrylate may be used in the manufacturing of release sheets. Different composition of the polymer layer may be selected according to different requirements such as easy to release, temperature resistance and good abrasive properties, etc.

In some occasions, the viscosity of oligomers is normally too high for coating application. Thus monomer diluents are normally needed to reduce the e-beam curable formulation viscosity. Some multifunctional molecules such as trimethylolpropane triacrylate (TMPTA) or glyceryl triacrylate (PGTA) that provide crosslinking sites for forming the polymeric network can also be added in the resin. Additives like clays and fillers could also be added for cost reduction. The release liner made by using cross-linked acrylate materials has good heat resistance and can be used for producing both polyurethane and polyvinyl chloride synthetic leather.

After the coating material 106 is cured, in step 306, the cured coating material 106 and the substrate 108 may be separated from the replicative surface. A release sheet 104 with the cured coating material 106 and the substrate 108 is produced.

Figure 4:
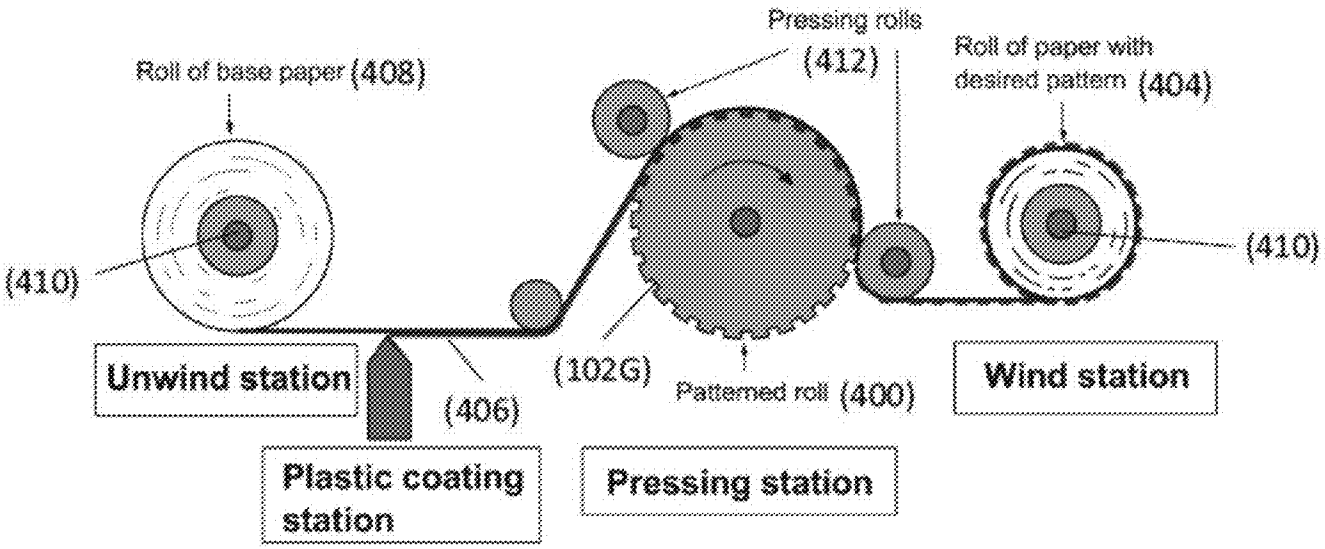
FIG. 4 is an illustration of a process of manufacturing a release sheet using a roll-to-roll system.

With reference to FIG. 4, an embossed release paper 404 is manufactured by coating an irradiation curable acrylate coating materials 406 onto an embossed metal plate 400 or metal drum, a paper web 408 covered with a base of pigment is pressed against the coating surface 400, then an electron beam is applied to the coating face 406 through the paper web layer 408 to cure the film of the coating 406, and then the metal roller 400 is separated from the produced release paper 404. Using this method, the embossed texture can be reproduced in high consistency.

In this example, the embossing roller 400 for use in the manufacturing of the embossed release paper 404 comprises a replicative surface 100 having the composite surface texture 102G including a predefined embossing pattern 102 and a surface morphology manipulated according to the previous example embodiments, which may include the steps of etching the replicative surface 100 of the embossing roller 400 using chemical etchants prior to the manufacturing of the release paper 404. The coating system may also include suitable substrate holder(s) 410 arranged to hold and manipulate a substrate of the release sheet, such as a plurality of rollers suitable for a roll-to-roll coating system. In addition, the coating system may also include suitable curing apparatus such as electron guns and/or temperature controlling modules, additional rollers 412 for adjusting the tension of the paper rolls 408 or to facilitate the coating process.

In some other embodiments, the coating system of FIG. 4 may be a coating stage of a system of manufacturing a release sheet for use in a manufacturing of synthetic leather, and the system may further comprises stages such as an embossing roller etching stage including a chemical etching stage for etching the replicative surface with a chemical etching, and a cleaning stage for cleaning the replicative surface before the replicative surface is etched and for quenching the chemical reaction of the chemical etchant on the replicative surface.

Figure 5:
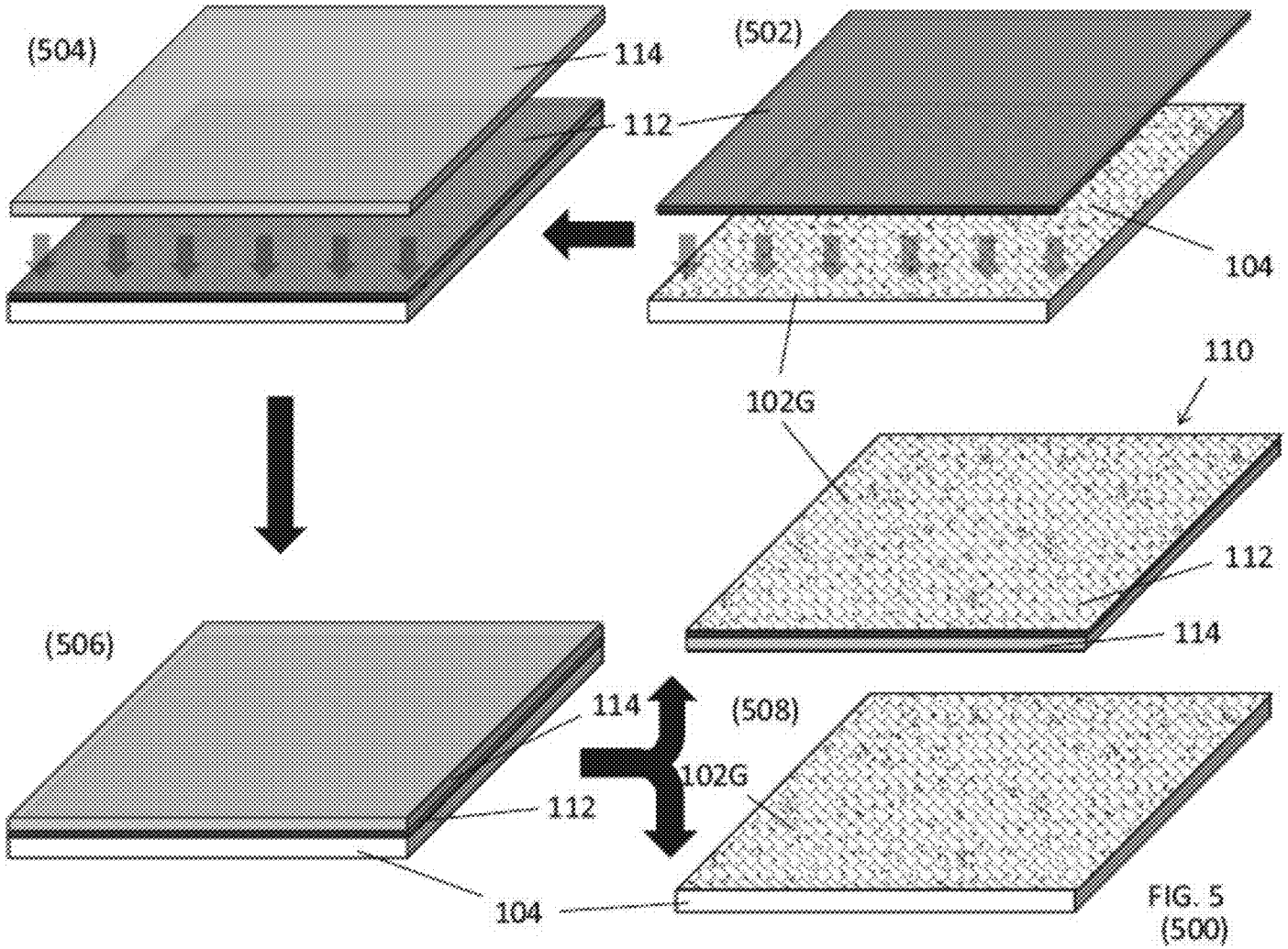
FIG. 5 is an illustration of a process of manufacturing synthetic leather using the release sheet of FIG. 3.

The release sheet 104 produced according to the above-mentioned process may be used for manufacturing synthetic leather 110. With reference to an example manufacturing process 500 as shown in FIG. 5, in step 502, a skin layer coating 112 is deposited on the release sheet 104. The skin layer coating 112 may consist of a curable polymer such as PU and/or PVC as discussed earlier, and the skin layer coating 112 may be dried (or cured) by evaporating solvent in the skin layer coating 112, and the skin layer 112 will be defined or embossed with the composite surface texture 102G having the predefined embossing pattern 102 as well as the surface morphology on the release paper 104. After that an adhesive layer may be deposited on the dried/cured skin layer coating 112, and then a substrate of the synthetic leather such as a fabric substrate 114 may be attached to the adhesive layer in step 504, so as to bind the skin layer coating 112 to the fabric substrate 114 in step 506. Optionally the combined skin layer coating 112, the adhesive layer and the fabric substrate 114 may be heated in step 506 to facilitate the binding of the skin layer coating 112 to the fabric substrate 114. Finally, in step 508, the skin layer coating 112 and the fabric substrate 114 may be detached and separated from the release sheet 104. A piece of synthetic leather 110 is produced.

In an example embodiment of producing polyurethane leather using the release paper, a polyurethane resin as a skin layer is applied first to the release sheet, and the coating is heated to ~130° C. to evaporate the solvent. Then, a second layer of adhesive together with the backing fabric are applied. The combined layers are then heated to ~100° C. for 3 minutes, and finally the release paper is peeled off. The drying temperature may vary from 100 to 150° C. depend on the PU materials.

In an example embodiment of producing PVC leather using the release paper, a PVC paste as a skin layer is applied first to the release sheet, and the coating is heated to ~200° C.-250° C. form a PVC layer. Then, a second layer of adhesive together with the backing fabric are applied. The combined layers are then heated, and finally the release paper is peeled off.

In an example embodiment of producing semi-PU leather using the release paper, a polyurethane resin as a skin layer is applied first to the release sheet, and the coating is heated to ~130° C. to evaporate the solvent. Then, a second layer of a PVC paste together with the backing fabric are applied. The combined layers are then heated to ~200° C.-250° C., and finally the release paper is peeled off.

It will be appreciated by a skilled person that the process of manufacturing of the release paper and/or the synthetic should not be limited to the abovementioned examples. For example, the coating processes may be carried out in roll-to-roll systems, but it may be modified to be carried out in other coating system such as a flat-bed coating stages, and various coating technologies such as but not limited to dip coating, gap coating, gravure coating, screen printing, spraying, inkjet printing may be adopted in any coating process involve in the present invention.

These embodiments may be advantageous in that gloss level developed on the replicative surface or the surface of an embossing roller for use in producing a release sheet is permanently formed or defined. This would enhance the repeatability of the surface effect and the gloss effect developed on the release sheet produced using the same embossing roller. Desired gloss level may be controlled by using different etching parameters applied in the chemical etching step, and is more controllable than controlling the gloss level forming directly on the release liner or the skin layer of the synthetic leather product using chemical additives and matting agent.

It is found that the method of modifying gloss level on the replicative surface is suitable for electron beam curing technology. Advantageously, the ability of duplicating 100% of the embossing roller texture, e-beam curing technique allows a more natural textured release paper to be produced. Thus the synthetic leather exhibits a more "real leather" perception, rather than artificial look.

Electron beam curing technology may be adopted with the use of embossing rollers with modified gloss levels, the manufacturing of the release sheet may be produced with higher quality than using thermal curing technologies, since thermally cured release paper may copy less detail of the texture on the rollers, and there is distortion of texture during the cooling process. In addition, thermal process also limits the range of chemical to be used in the coating solution, and may include volatile organic carbon (VOC) which is undesirable.

Figure 6:
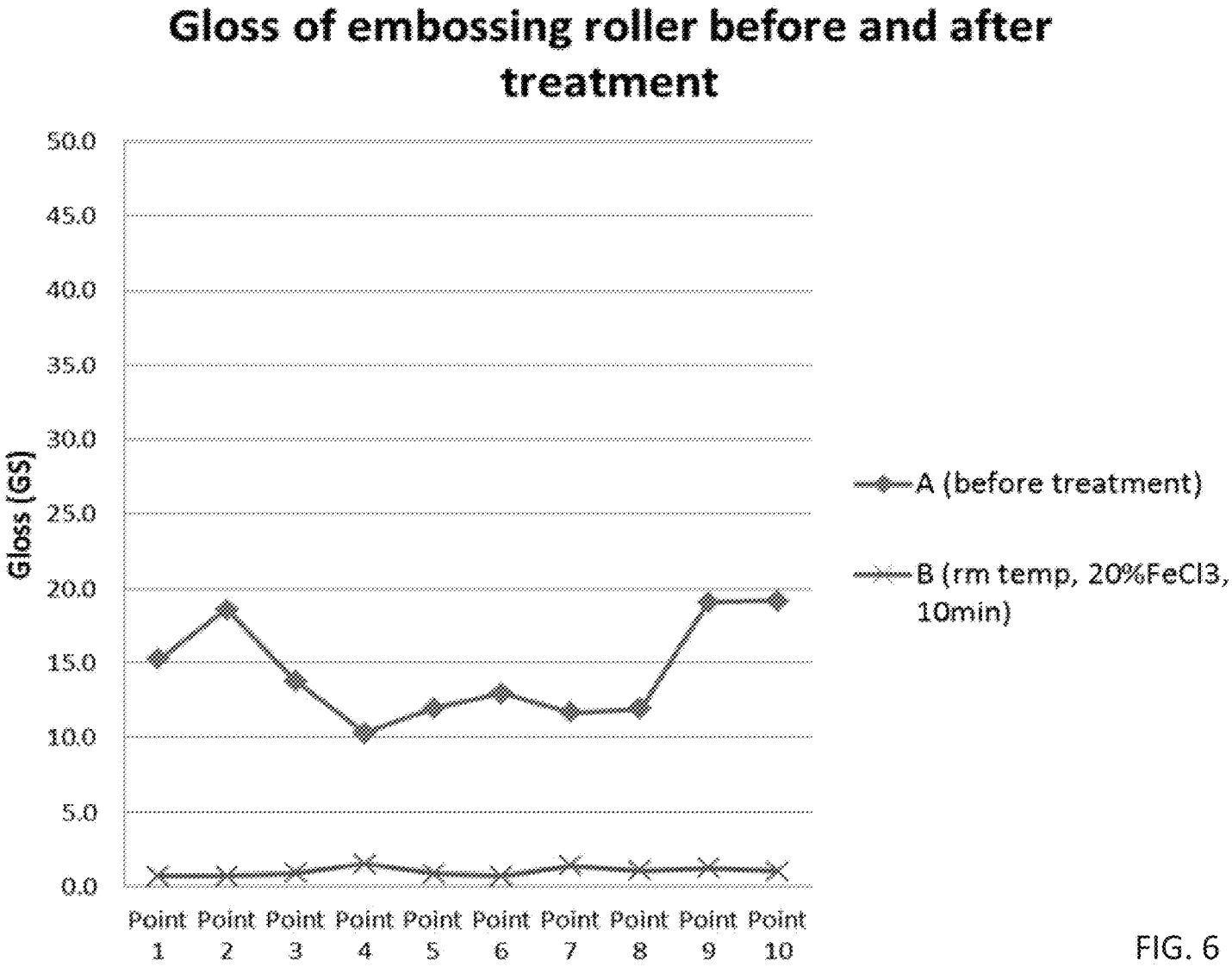
FIG. 6 is a plot showing a gloss of an embossing roller before and after a chemical treatment in accordance with an embodiment of the present invention.

With reference to FIG. 6, there is a set of measurement results of different positions on an embossing roller after different etching processes. It is observed that after the etching processes, the final gloss levels on different positions along the embossing roller are uniformly modified, and the measured gloss level to supressed to a value substantially close to zero on different positions of the roller. Thus a good uniformity on a release sheet produced using the modified of the embossing roller could be obtained.

Figure 7:
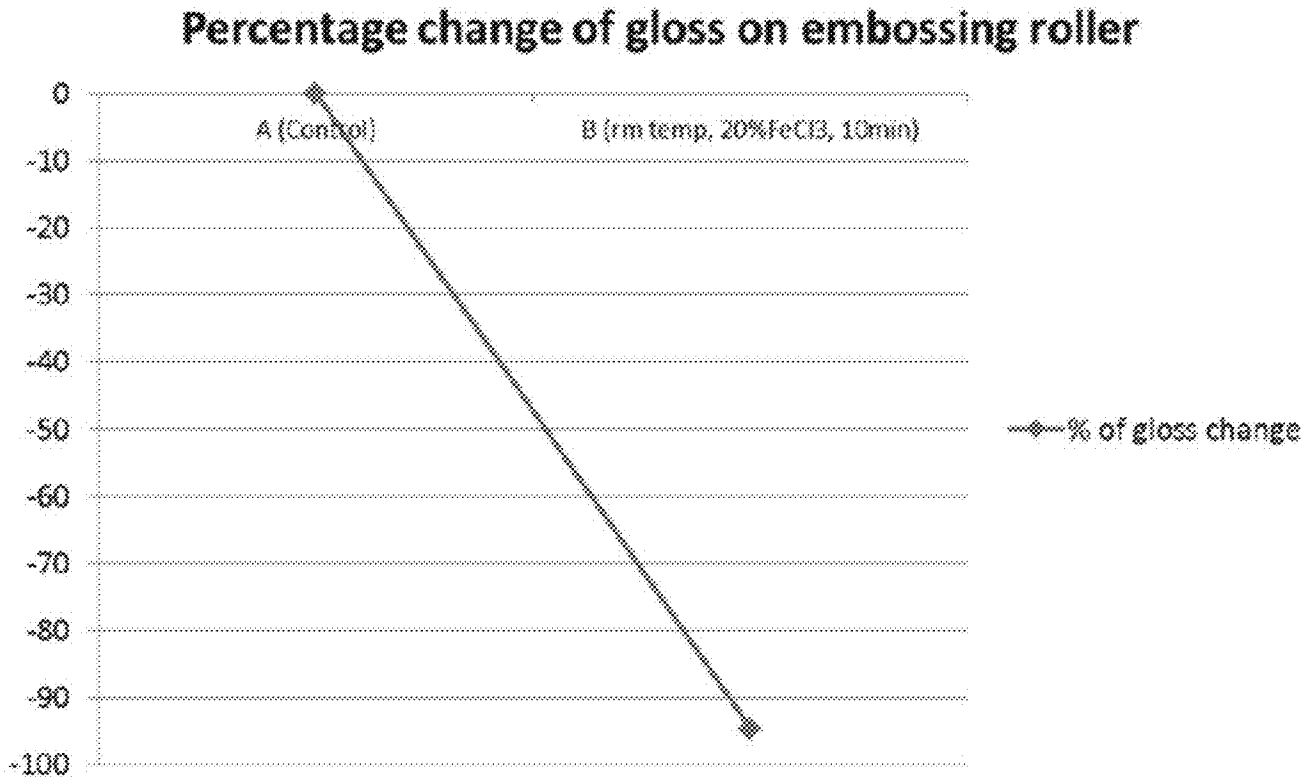
FIG. 7 is a plot showing a percentage change of gloss on an embossing roller after a chemical treatment in accordance with an embodiment of the present invention.

With reference to FIG. 7, there is shown the percentage change of gloss on embossing roller before and after the etching process in accordance with an embodiment of the present invention. By etching the embossing roller with 20% ferric chloride solution for 10 minutes at room temperature, the gloss of the surface of the embossing roller is decreased by about 95%.

Figure 8:
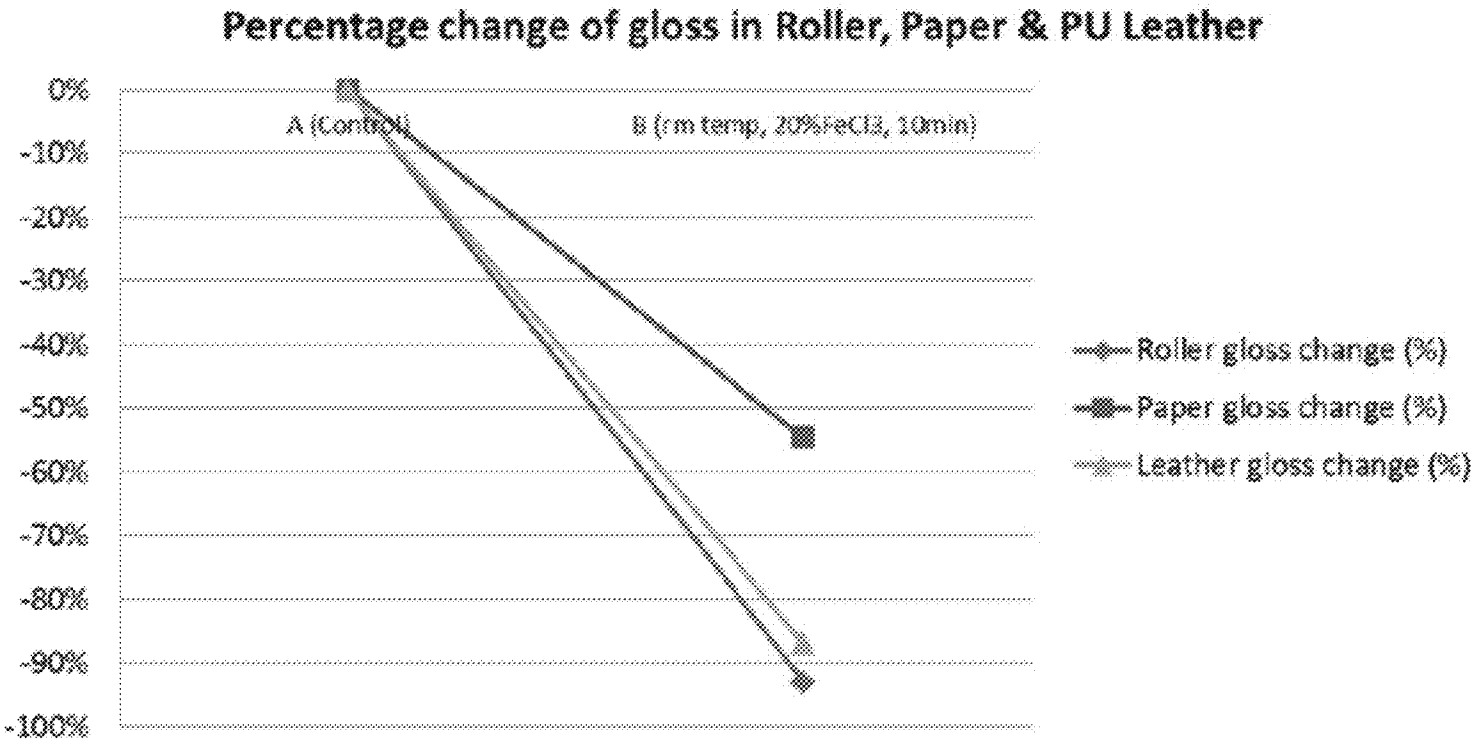
FIG. 8 is a plot showing a percentage change of gloss on an embossing roller, a release paper manufactured using the embossing and a PU leather manufactured using the release paper after a chemical treatment on the embossing roller in accordance with an embodiment of the present invention.

With reference to FIG. 8, the embossing rollers etched according to the etching processes as shown in FIGS. 6 and 7 are used for manufacturing release papers with different gloss, and the different pieces of release paper are further used for manufacturing synthetic leather. As shown in FIG. 8, the gloss level on the surface of the release paper and the synthetic leather produced by the modified roller were measured and were decreased by about 55% and 90% respectively. These results suggest that the gloss level of synthetic leather products may be modified by using release paper with modified gloss level, and the gloss level of the release paper may be transferred from the modified surface of the embossing roller.

Figure 9:
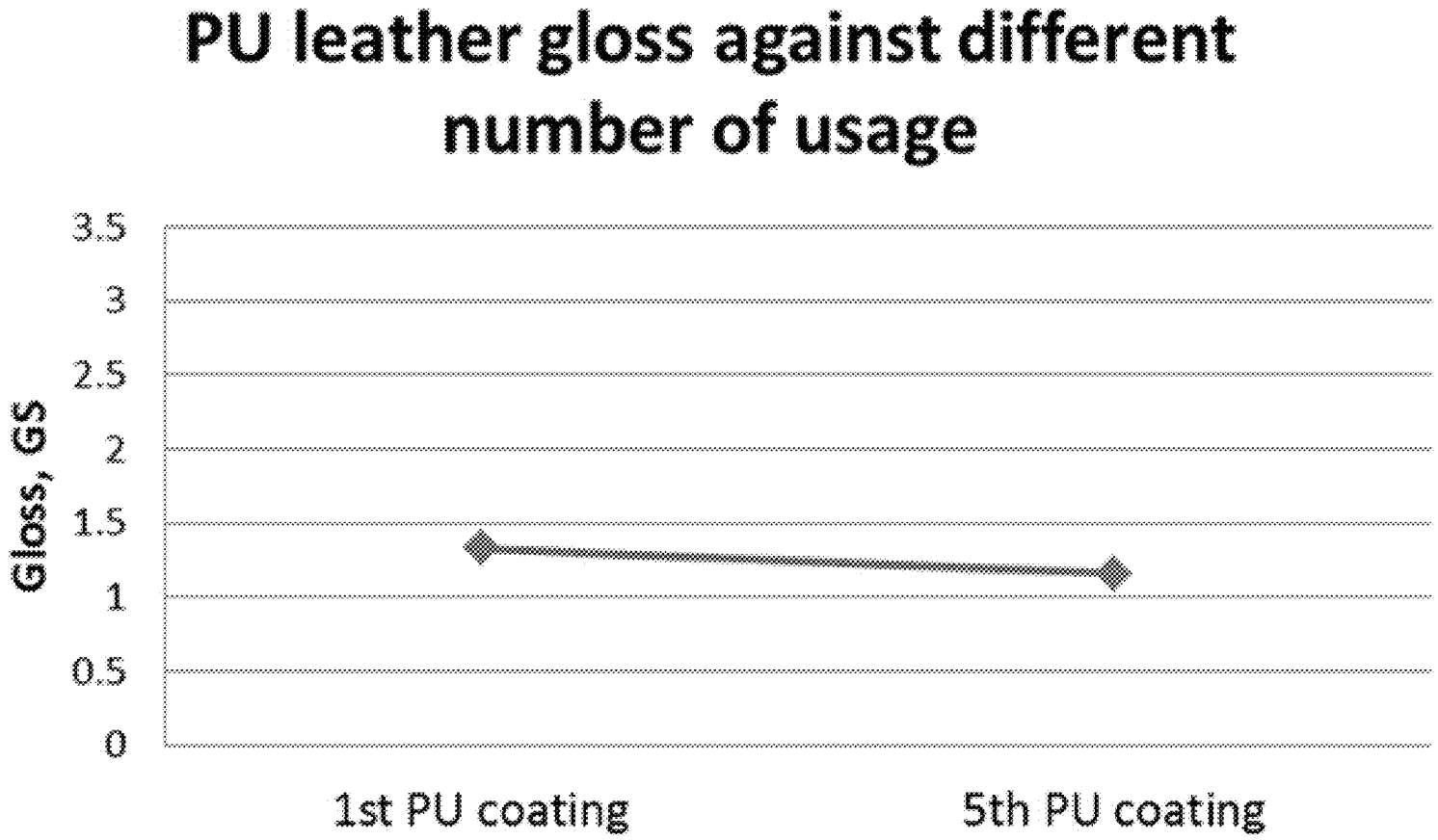
FIG. 9 is a plot showing a percentage change of gloss on a PU leather manufactured using a release paper manufactured in accordance with an embodiment of the present invention, wherein the release paper was (re)used multiple times.

With reference to FIG. 9, it is shown that the gloss of the synthetic leather produced using a piece of release paper freshly produced according to an embodiment of the invention and with the same piece of release paper has been used for five times. The results show that the gloss levels of the two samples of synthetic leather produced are comparable, and the manufactured release paper is reusable for multiple times to minimize cost and material waste for the manufacturing of synthetic leather.

Advantageously, the embodiments of the present invention provides a controllable method for modifying the gloss level of the release paper by etching the embossing roller with different etching conditions so as to obtain a desired gloss level of the release paper and hence the desired gloss level of the final synthetic leather product.

Figure 10:
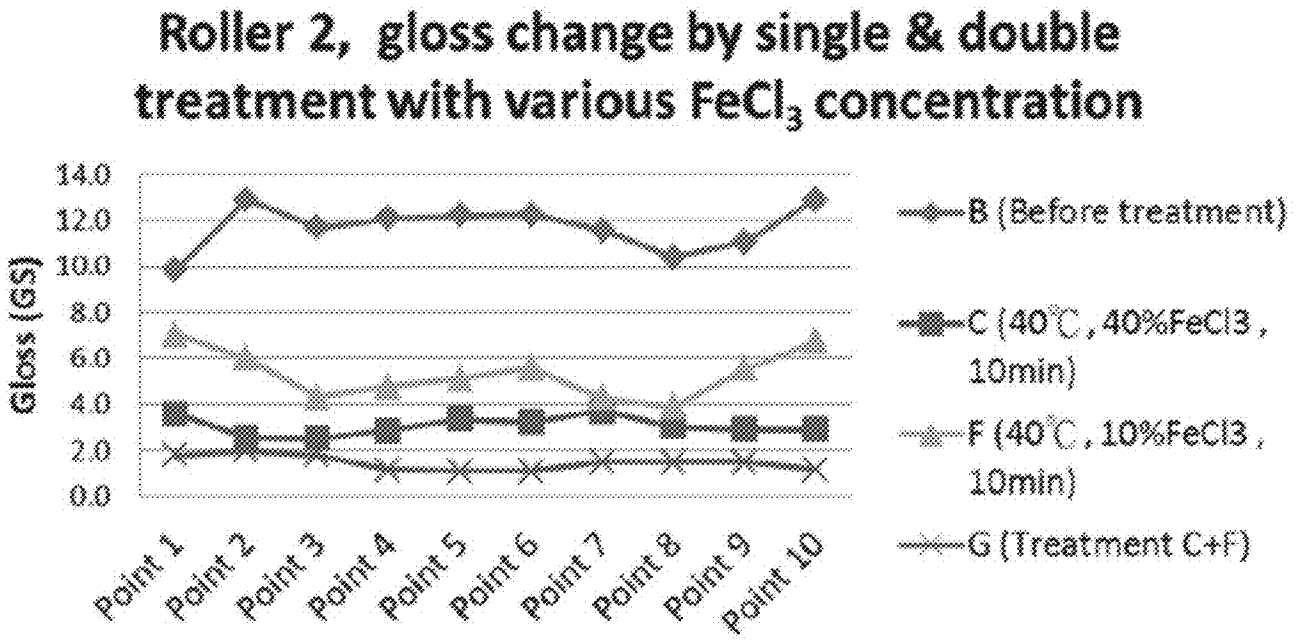
FIG. 10 is a plot showing a gloss of an embossing roller before and after a chemical treatment with treatment conditions different from the one in the example of FIG. 5.
Figure 11:
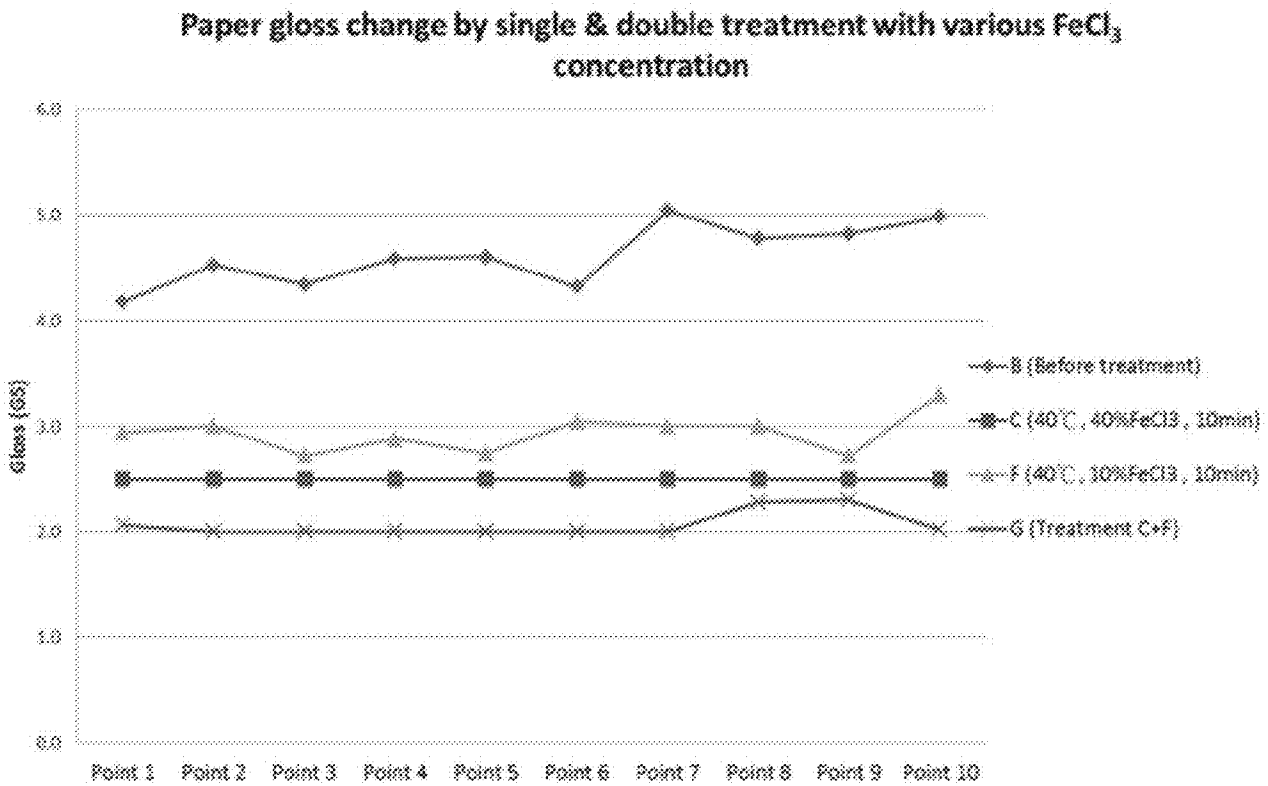
FIG. 11 is a plot showing a change of gloss on a release paper manufactured according to the treatment condition of FIG. 9.

With reference to FIGS. 10 and 11, it is observed that using the etching solution with 40° C., the roller treated with 40% etching solution showed a lower gloss value than that of 10% etching solution. The gloss levels generally decreases with increased concentration of ferric chloride in the etchant used in the chemical etching process. It is observed that the etching process is highly controllable.

If lower gloss effect is needed, treating the roller twice can make the gloss even lower (effect G). The trend shown in the roller gloss change is similar to the paper gloss change.

Figure 12:
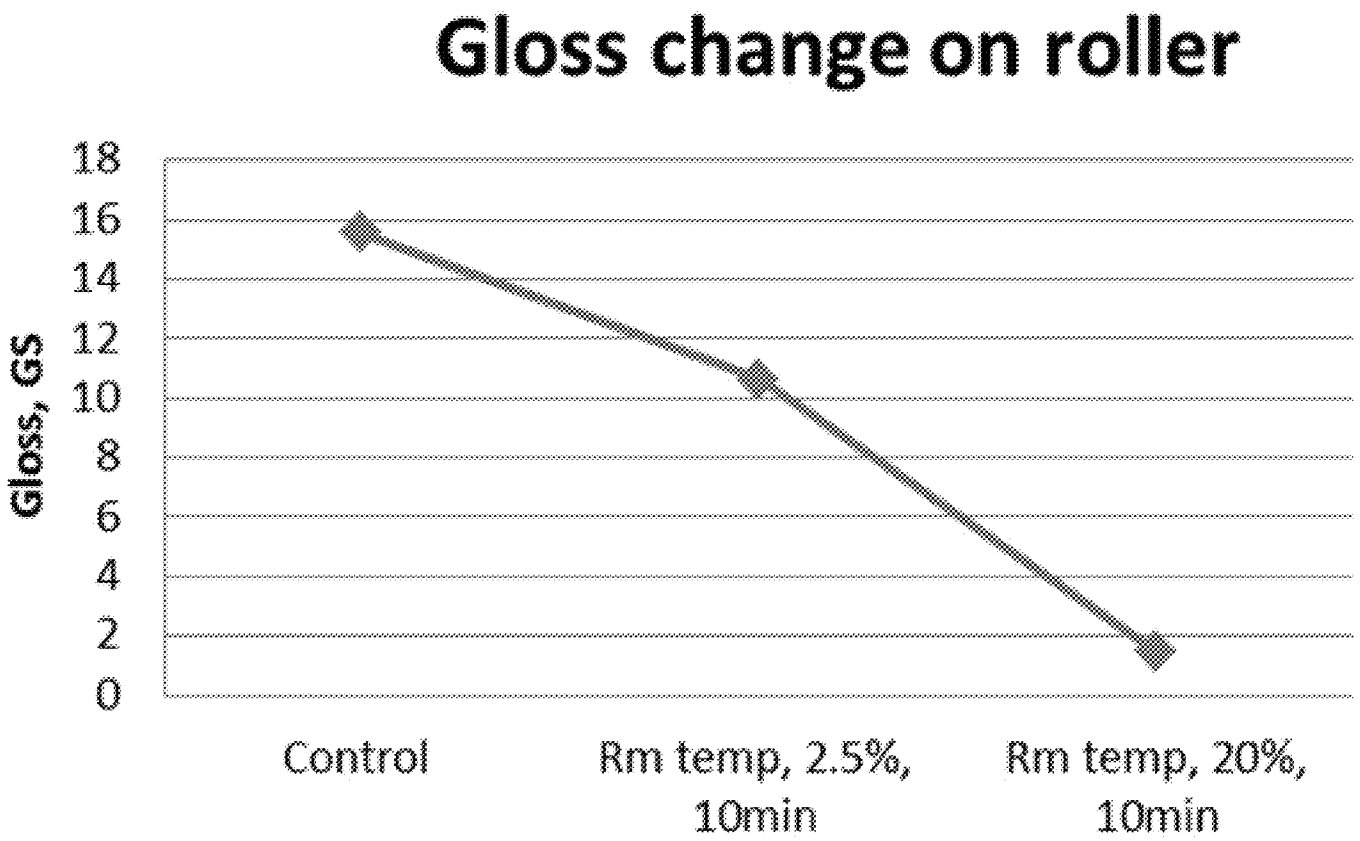
FIG. 12 is a plot showing a change of gloss of different embossing rollers after different chemical treatment in accordance with an embodiment of the present invention.
Figure 13:
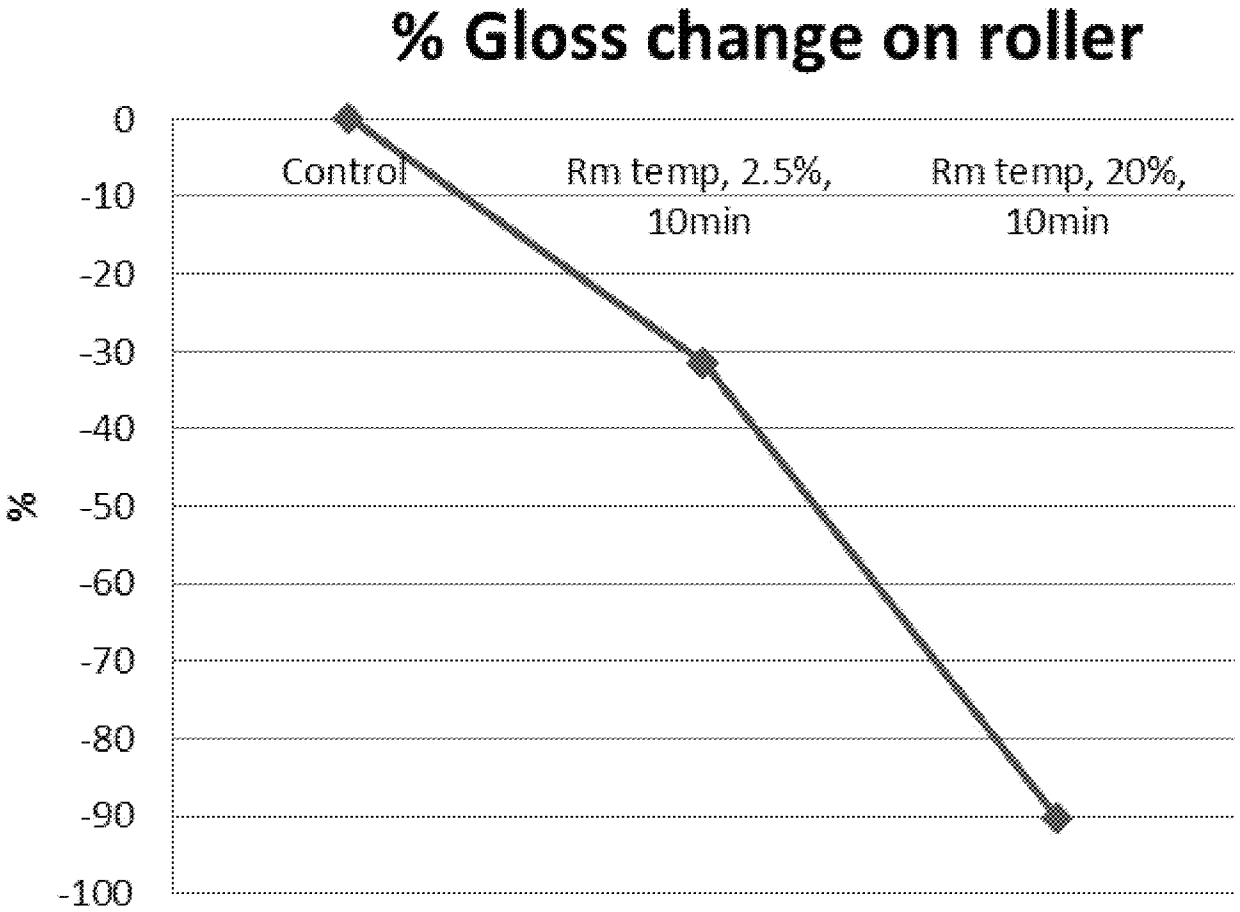
FIG. 13 is a plot showing a percentage change of gloss of different embossing rollers after different chemical treatment in accordance with an embodiment of the present invention.

With reference to FIGS. 12 and 13, it is shown that the gloss changes of rollers are very similar when the gloss of roller is higher than 2 GS. It is also observed that when the roller gloss is as low as 2 GS, more concentrated etching solution also will not affect the gloss of roller.

These results suggest that the etching process may be performed multiple times which enables the gloss of the embossing roller may be fine-tuned by using a multiple steps etching process so as to obtained an optimized gloss effect on the embossing roller for the subsequent manufacturing process of a release paper.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A method of manufacturing a release sheet for use in replicative embossing, comprising the steps of:

manipulating a surface morphology of a replicative surface having a predefined embossing pattern so as to define a composite surface texture combining the predefined embossing pattern and the manipulated surface morphology on the replicative surface; and depositing and embossing a coating material on a substrate of the release sheet with the replicative surface;

wherein the composite surface texture of the replicative surface is transferred to the coating material of the release sheet, and the step of manipulating the surface morphology of the replicative surface includes etching the replicative surface with a chemical etchant.

2. A method of manufacturing a release sheet in accordance with claim 1, wherein the manipulated surface morphology is developed across the entire replicative surface and the predefined embossing pattern.

3. A method of manufacturing a release sheet in accordance with claim 1, wherein the step of manipulating the surface morphology of the replicative surface includes modifying a gloss level of the replicative surface.

4. A method of manufacturing a release sheet in accordance with claim 1, wherein the chemical etchant includes at least one of ferric chloride, ferric nitrate, nitric acid and hydrochloric acid.

5. A method of manufacturing a release sheet in accordance with claim 4, wherein the concentration of ferric chloride solution is in a range of 0%-50% by mass.

6. A method of manufacturing a release sheet in accordance with claim 1, wherein the step of etching the replicative surface with the chemical etchant comprises the steps of:

pouring the chemical etchant on the replicative surface for a predetermined etching period;

brushing the replicative surface when the chemical etchant is poured on the replicative surface; and when upon the predetermined etching period is lapsed, stop pouring the chemical etchant on the replicative surface and pouring a predetermined amount of water on the replicative surface, wherein the predetermined amount of water is arranged to quench a chemical reaction of the chemical etchant poured on the replicative surface.

7. A method of manufacturing a release sheet in accordance with claim 1, further comprising the step of washing the replicative surface with water before the step of etching the replicative surface with a chemical etchant.

8. A method of manufacturing a release sheet for use in replicative embossing, comprising the steps of:

manipulating a surface morphology of a replicative surface having a predefined embossing pattern so as to define a composite surface texture combining the predefined embossing pattern and the manipulated surface morphology on the replicative surface; and depositing and embossing a coating material on a substrate of the release sheet with the replicative surface;

wherein the composite surface texture of the replicative surface is transferred to the coating material of the release sheet, and the step of manipulating the surface morphology of the replicative surface further comprises the step of mechanically polishing the replicative surface.

9. A method of manufacturing a release sheet for use in replicative embossing, comprising the steps of:

manipulating a surface morphology of a replicative surface having a predefined embossing pattern so as to define a composite surface texture combining the predefined embossing pattern and the manipulated surface morphology on the replicative surface; and depositing and embossing a coating material on a substrate of the release sheet with the replicative surface;

wherein the composite surface texture of the replicative surface is transferred to the coating material of the release sheet, and the replicative surface is made of a metallic material.

10. A method of manufacturing a release sheet for use in replicative embossing, comprising the steps of:

manipulating a surface morphology of a replicative surface having a predefined embossing pattern so as to define a composite surface texture combining the predefined embossing pattern and the manipulated surface morphology on the replicative surface; and depositing and embossing a coating material on a substrate of the release sheet with the replicative surface;

wherein the composite surface texture of the replicative surface is transferred to the coating material of the release sheet, and the step of depositing and embossing the coating material on a substrate of the release sheet with the replicative surface includes the steps of:

applying the coating material to the replicative surface; and transferring the coating material to the substrate by pressing the substrate against the replicative surface.

11. A method of manufacturing a release sheet for use in replicative embossing, comprising the steps of:

manipulating a surface morphology of a replicative surface having a predefined embossing pattern so as to define a composite surface texture combining the predefined embossing pattern and the manipulated surface morphology on the replicative surface; and depositing and embossing a coating material on a substrate of the release sheet with the replicative surface;

wherein the composite surface texture of the replicative surface is transferred to the coating material of the release sheet, and the coating material is irradiation curable.

12. A method of manufacturing a release sheet in accordance with claim 11, further comprising the step of curing the coating material deposited on the substrate.

13. A method of manufacturing a release sheet in accordance with claim 12, wherein the coating material is cured with electron beam energy.

14. A method of manufacturing a release sheet in accordance with claim 12, further comprising the step of separating the cured coating material and the substrate from the replicative surface.

15. A method of manufacturing a release sheet in accordance with claim 1, wherein the coating material consists of acrylate.

16. A method of manufacturing a release sheet in accordance with claim 1, wherein the substrate includes paper.

17. A method of manufacturing a release sheet in accordance with claim 9 or 11, wherein the manipulated surface morphology is developed across the entire replicative surface and the predefined embossing pattern.

18. A method of manufacturing a release sheet in accordance with claim 9 or 11, wherein the step of manipulating the surface morphology of the replicative surface includes modifying a gloss level of the replicative surface.

* * * * *